US006111203A

United States Patent [19]

Cheng et al.

[11] Patent Number: 6,111,203

[45] Date of Patent: Aug. 29, 2000

[54] GROUND PLANE CABLE ASSEMBLY UTILIZING RIBBON CABLE

[75] Inventors: Ken Cheng; Chih-Hsien Chou, both of Cupertino; Eric Juntwait, Irvine, all of Calif.

[73] Assignee: Hon Hai Precision Ind. Co., Ltd., Taipei Hsien, Taiwan

[21] Appl. No.: 09/087,450

[22] Filed: May 29, 1998

[51] Int. Cl.[7] ..... H01B 7/08

[52] U.S. Cl. ..... 174/117 F

[58] Field of Search ..... 174/117 F, 117 A, 174/115, 36

[56] References Cited

U.S. PATENT DOCUMENTS

| | | | |
|---|---|---|---|
| 4,428,790 | 1/1984 | Diaz | 156/86 |
| 4,513,170 | 4/1985 | Apodaca | 174/36 |
| 4,564,723 | 1/1986 | Lang | 174/36 |
| 4,698,457 | 10/1987 | Bordbar | 174/36 |
| 4,972,041 | 11/1990 | Crawley et al. | 174/36 |
| 5,008,490 | 4/1991 | Strauss et al. | 174/36 |
| 5,360,944 | 11/1994 | Springer et al. | 174/117 F |
| 5,552,565 | 9/1996 | Cartier et al. | 174/117 F |
| 5,665,940 | 9/1997 | Chimura et al. | 174/117 F X |

*Primary Examiner*—Kristine Kincaid
*Assistant Examiner*—Chau N. Nguyen

[57] ABSTRACT

A ground plane cable assembly (10) includes a flat ribbon cable (12) and a ground plane (18) sandwiching a dielectric spacer (20) therebetween wherein several openings are provided in the dielectric spacer (20) to lower the capacitance between the flat ribbon cable (12) and the ground plane (18) so that the impedance of the whole cable assembly (10) can be raised to a relative high value without increasing the thickness of the dielectric spacer (20).

8 Claims, 1 Drawing Sheet

GROUND PLANE CABLE ASSEMBLY UTILIZING RIBBON CABLE

BACKGROUND OF THE INVENTION

1. Field of the Invention

The invention relates to a cable assembly, and particularly to a ground plane cable assembly utilizing a flat ribbon cable.

2. The Prior Art

Historically, cable assemblies and connectors within a computer transfer data at speed, which do not readily lead to signal degradation due to electromagnetic phenomenon such as impedance, skew, propagation delay, and crosstalk. As signal speed continues to increase, however, these phenomena can create sever problems within the computer system. An effort is therefore being made to control various electrical characteristics of cable assemblies and associated connectors within the computer enclosure.

The well known technology for avoiding aforementioned signal degradation is to use a ground plane associated with the traditional flat ribbon cable wherein the ground plane directly abuts against the flat cable. Anyhow, in such design, the impedance can not be raised to a desired level during a high speed transmission. Therefore, based on a theory that the impedance is of inverse proportion to the capacitance, it is required to have a dielectric layer positioned between the ribbon flat cable and the ground plane for reducing the capacitance. Moreover, due to the limited properties of such dielectric layer, generally such dielectric layer should maintain a significant thickness to obtain a required lower level of the capacitance. It will result in a heavy and thicker cable assembly. Thus, it is further desired to modify such dielectric layer for maintaining a thinner thickness while still providing the desired lower level of the corresponding capacitance between the conductors of the flat ribbon cable and the ground plane.

Therefore, an object of the invention is to provide a ground plane cable assembly utilizing a flat ribbon cable wherein the capacitance between flat ribbon cable and the ground plane reaches a relative low level in comparison with the prior art.

SUMMARY OF THE INVENTION

According to an aspect of the invention, a ground plane cable assembly includes a flat ribbon cable and a ground plane sandwiching a dielectric spacer therebetween wherein several openings are provided in the dielectric spacer to lower the capacitance between the flat ribbon cable and the ground plane so that the impedance of the whole cable assembly can be raised to a relative high value without increasing the thickness of the dielectric spacer.

DETAILED DESCRIPTION OF THE PREFERRED EMBODIMENTS

Figure 1:
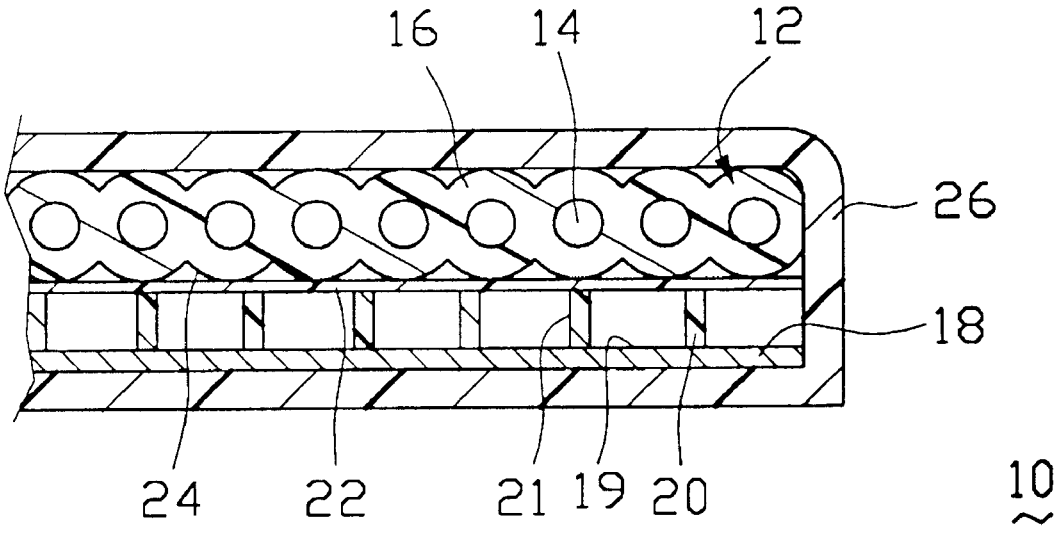
FIG. 1 is a partial cross-sectional view of a presently preferred embodiment of a ground plane cable assembly according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. wherein the ground plane cable assembly 10 includes a traditional flat ribbon cable 12 having a plurality of conductors 14 therein surrounded by insulative cover 16. A ground plane 18 is provided under the flat ribbon cable 12 in a parallel relationship with regard to the flat ribbon cable 12. A mesh type dielectric spacer, i.e., a buffer 20, is provided between the flat ribbon cable 12 and the ground plane 18 wherein plural through openings 21 are provided in the buffer 20 and are empty without anything embedded therein. A double sided adhesive layer 22 is disposed between the under surface 24 of the flat ribbon cable 12 and the buffer 20 so as to adhesively combine the buffer 20 and flat ribbon cable 12 together on two sides of the adhesive layer 22.

A jacket 26 protectively surrounds the combined ground plane 18 and the flat ribbon cable 12 to finalize the whole assembly 10. It can be understood that two opposite ends of the whole assembly 10 may be connected to other electrical components through IDC (Insulative Displacement Contact) connectors (not shown).

It is appreciated that in this embodiment, the jacket is of a tape form with adhesive on the inner surface for securely circumscribing the ground plane 18 and the flat ribbon cable 12 therein. Additionally, the ground plane 18 also provides adhesive on the upper surface 19 for attachment to the buffer 20.

Figure 2:
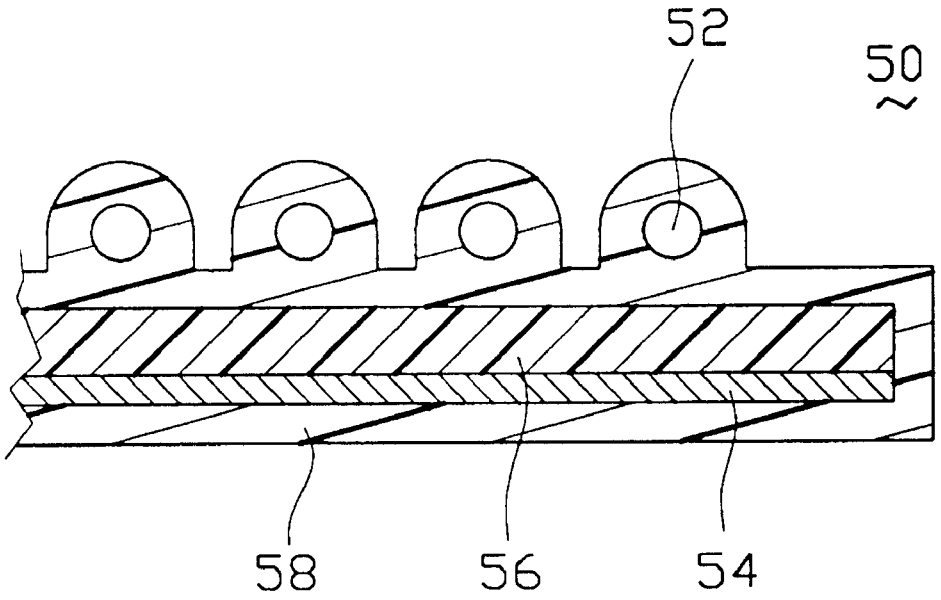
FIG. 2 is a partial cross-sectional view of a second embodiment of a ground plane cable assembly.

FIG. 2 shows another embodiment wherein the whole cable assembly 50 includes a plurality of side-by-side conductors 52 and a ground plane 54 spaced from each other by a solid buffer 56 therebetween, and the cable assembly 50 is provided with a insulation jacket 58 on the exterior surface to form integration thereof.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A ground plane cable assembly, including:

a flat ribbon cable with a plurality of juxtaposed conductors thereof;

a ground plane disposed in a parallel relation with regard to the flat ribbon cable; and a buffer being sandwiched between the flat ribbon cable and the ground plane, and defining therein a plurality of through openings; wherein said through openings are empty, without anything significantly embedded therein, so as to efficiently lower capacitance between the ribbon cable and the ground plane.

2. The assembly as defined in claim 1, wherein said buffer is of a mesh type.

3. The assembly as defined in claim 1, wherein a jacket protectively covers the ground plane and the flat ribbon cable.

4. The assembly as defined in claim 1, wherein a double sided adhesive layer is provided between the buffer and the flat ribbon cable.

5. The assembly as defined in claim 3, wherein the jacket is of a tape form having adhesive on an interior surface.

6. The assembly as defined in claim 1, wherein said ground plane is provided with adhesive on a surface for attachment to the buffer.

7. A method for assembling a grounding plane cable assembly, the steps comprising:

preparing a traditional flat ribbon cable;

positioning a buffer on one side of said flat ribbon cable, said buffer defining a plurally of through openings therein;

positioning a ground plane on the buffer opposite to the flat ribbon cable; and providing a jacket to protectively surround said flat ribbon cable, said buffer and said ground plane; wherein said through openings remain empty for efficiently lowering capacitance between the ribbon cable and the ground plane.

8. The method as defined in claim 7, wherein a double sided adhesive layer is provided to said one side of the flat ribbon cable before positioning the buffer unto said one side of the flat cable.

* * * * *